US008270658B2

(12) United States Patent
Goldberg et al.

(10) Patent No.: US 8,270,658 B2
(45) Date of Patent: Sep. 18, 2012

(54) POSITION SENSING APPARATUS AND METHOD FOR ACTIVE HEADWORN DEVICE

(75) Inventors: Jack Goldberg, San Diego, CA (US); Randy L. Houk, San Diego, CA (US); Michael J. Stern, Westlake Village, CA (US); Luk Ching Chug, Hong Kong (CN)

(73) Assignee: Hearing Enhancement Group, Thousand Oaks, CA (US)

( * ) Notice: Subject to any disclaimer, the term of this patent is extended or adjusted under 35 U.S.C. 154(b) by 1178 days.

(21) Appl. No.: 12/110,692

(22) Filed: Apr. 28, 2008

(65) Prior Publication Data

US 2009/0268936 A1 Oct. 29, 2009

(51) Int. Cl.
*H04R 5/033* (2006.01)

(52) U.S. Cl. ..... 381/384; 381/383; 381/370; 381/379

(58) Field of Classification Search ..... 381/384, 381/370, 379, 383
See application file for complete search history.

(56) References Cited

U.S. PATENT DOCUMENTS

| | | | | |
|---|---|---|---|---|
| 5,708,725 | A * | 1/1998 | Ito | 381/370 |
| 7,193,728 | B2 * | 3/2007 | Ichikawa et al. | 356/614 |
| 7,456,852 | B2 * | 11/2008 | Mori et al. | 345/690 |
| 7,903,833 | B2 * | 3/2011 | Goldberg et al. | 381/329 |
| 7,940,947 | B2 * | 5/2011 | Kaulfuss et al. | 381/374 |
| 2008/0110987 | A1 * | 5/2008 | Cato et al. | 235/437 |
| 2008/0125288 | A1 * | 5/2008 | Case | 482/1 |

* cited by examiner

*Primary Examiner* — Tom Thomas
*Assistant Examiner* — Benjamin Tzu-Hung Liu
(74) *Attorney, Agent, or Firm* — Parsons Behle & Latimer

(57) ABSTRACT

An active headworn device that includes a position sensing device used to determine whether the headworn device is in an extended state upon a user's head or in a contracted state off of the user's head. The position sensing device may be coupled with a microcontroller adapted to power up or power down the active headworn device based on a signal from the position sensing device. The position sensing device may various devices such as a Hall-effect device used in combination with a magnet or a LED in combination with a detector. The movement of the headworn device between positions changes the distance between components of the position sensing device such that the device signals the microcontroller to power up or down the active headworn device. The microcontroller may mute a portion of circuitry prior to the powering up or down the active headworn device to prevent undesirable feedback.

19 Claims, 7 Drawing Sheets

POSITION SENSING APPARATUS AND METHOD FOR ACTIVE HEADWORN DEVICE

BACKGROUND

The present application relates to a device for sensing the position of a headworn device such as, for example, a headworn listening device as disclosed in U.S. patent application Ser. No. 11/682,837 entitled "HEADWORN LISTENING DEVICE AND METHOD," filed Mar. 6, 2007 by Jack Goldberg et. al, which is herein incorporated by reference in its entirety. A position sensing apparatus is mechanically coupled to a headworn device in such a manner as to detect whether or not the headworn device is positioned on a user's head.

There presently exists a variety of headworn devices, some of which involve the presentation of sound into one or both ears and some of which assist in speech communication, such as assistive listening devices, wireless headphones, tactical headsets and telecommunication headsets. Some headworn devices may involve the presentation of images into one or both eyes, such as virtual reality headgear used for gaming or for military or other job training applications.

In cases where the headworn device is powered by a battery (herein referred to as an "active headworn device"), it is desirable to lessen or reduce the drain on the battery when the active headworn device is not in use, thereby increasing the useful life of the battery. Commonly, an active headworn device includes an on-off switch or some other means of manually turning the device on and off. Thus, in order to minimize battery drain, a user must remember to turn off the device when not in use. Thus, it would be desirable to have an active headworn device that is adapted to automatically turn off when not in use.

There are many situations where an individual may wish to better perceive sound or other sonic information in his or her environment through the use of an active headworn device. A headworn listening device such as described in U.S. patent application Ser. No. 11/682,837 and other listening devices for hunters or for the hard of hearing, include at least one microphone for picking up sound in the user's environment. In some cases, if the listening device is on, feedback may occur, especially when the listening device is located off the user's head. This feedback, which may be a whistling or humming sound, is unpleasant and likely to be annoying to those in proximity of the device. Similarly, when other types of active headworn devices are removed from the user's head while turned on there may be undesirable sounds, undesirable visuals or other undesirable conditions. Further, when an active headworn device is placed onto the user's head and turned on there may be transient undesirable sounds such as pops or clicks, undesired visuals such as flashes or distorted images if the active headworn device includes a visual display, or other undesired conditions. Thus, it would be desirable to eliminate undesirable transient conditions which may occur during times when the device is turned on or turned off.

SUMMARY

The above-mentioned drawbacks associated with existing systems are addressed by embodiments of the present application, which will be understood by one of ordinary skill in the art upon reading and studying the following specification.

The present application describes a position sensing apparatus and method applicable to a variety of active headworn devices. Various embodiments of the position sensing apparatus are described along with methods for their use. In one embodiment, an active headworn device includes a position sensing element adapted to automatically turn off the active headworn device when the device is removed from the head of a user. In one embodiment, the position sensing element may be a Hall-effect switch with a corresponding magnet. In another embodiment, the position sensing element may include a light emitting device in combination with a detecting device. As would be appreciated by one of ordinary skill in the art having the benefit of this disclosure, the active headworn device does not require customized fitting to an individual user.

A Hall-effect switch is a semiconductor device in which the presence of a magnetic field of sufficient strength will cause the output of the semiconductor device to turn on. In one embodiment, the position sensing element is a Hall-effect switch. A magnet changes position when the headworn device is either removed from the user's head or placed onto the user's head. The Hall-effect switch is adapted such that it is actuated either in the on-head or off-head position; thus the output of the Hall-effect switch is indicative of whether or not the active headworn device is on the user's head.

One embodiment is suitable for use with an active headworn device comprising a headband and at least one auxiliary structure, for example, an earcup, operatively connected to the headband and located either on the right or left side of the headband. The auxiliary structure's position with respect to the headband is variable and has a different position when the active headworn device is on the user's head as compared to when the active headworn device is off the user's head. At least one Hall-effect switch is mounted on an auxiliary structure and a magnet is mounted on the headband or on an extension of the headband such that the proximity of the magnet to the Hall-effect switch changes when the headworn device is removed or placed onto the user's head. This change of relative distance between the magnet and the Hall-effect switch may be ensured by a spring loaded mechanism or the stiffness of the headband.

In one embodiment of the apparatus, a magnet is located external to an auxiliary structure connected to a headband. The auxiliary structure includes at least one Hall-effect switch. Headband stiffness ensures that when the active headworn device is removed from a user's head the distance between the magnet and at least one Hall-effect switch is such that the Hall-effect switch is in the off state. Conversely, when the active headworn device is placed on the user's head, the distance between the magnet and the Hall-effect switch is substantially reduced such that the Hall-effect switch is switched to the on state.

In one embodiment, the output of a Hall-effect switch is operatively connected to a microcontroller. The microcontroller is configured such that the headworn device automatically turns itself off a short time after the device is removed from the user's head. The microcontroller can be further configured to immediately mute audio output from the headworn device when it is removed from the user's head, thus eliminating any potential for feedback. In another embodiment, placing the headworn device on the user's head turns on the device in a manner which avoids unwanted pops or clicks or other transient audio or visual signals by, for example, muting audio or disconnecting a portion of the circuitry for a time before normal operation commences.

In another embodiment, the state of a Hall-effect switch directly controls whether the active headworn device is powered on or off. In this embodiment, the active headworn device automatically turns on when the user places the device on his or her head and automatically turns off when the user removes the device from his or her head.

DETAILED DESCRIPTION

In the following detailed description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that various changes may be made without departing from the spirit and scope of the present invention. The following detailed description is, therefore, not to be taken in a limiting sense.

Figure 1:
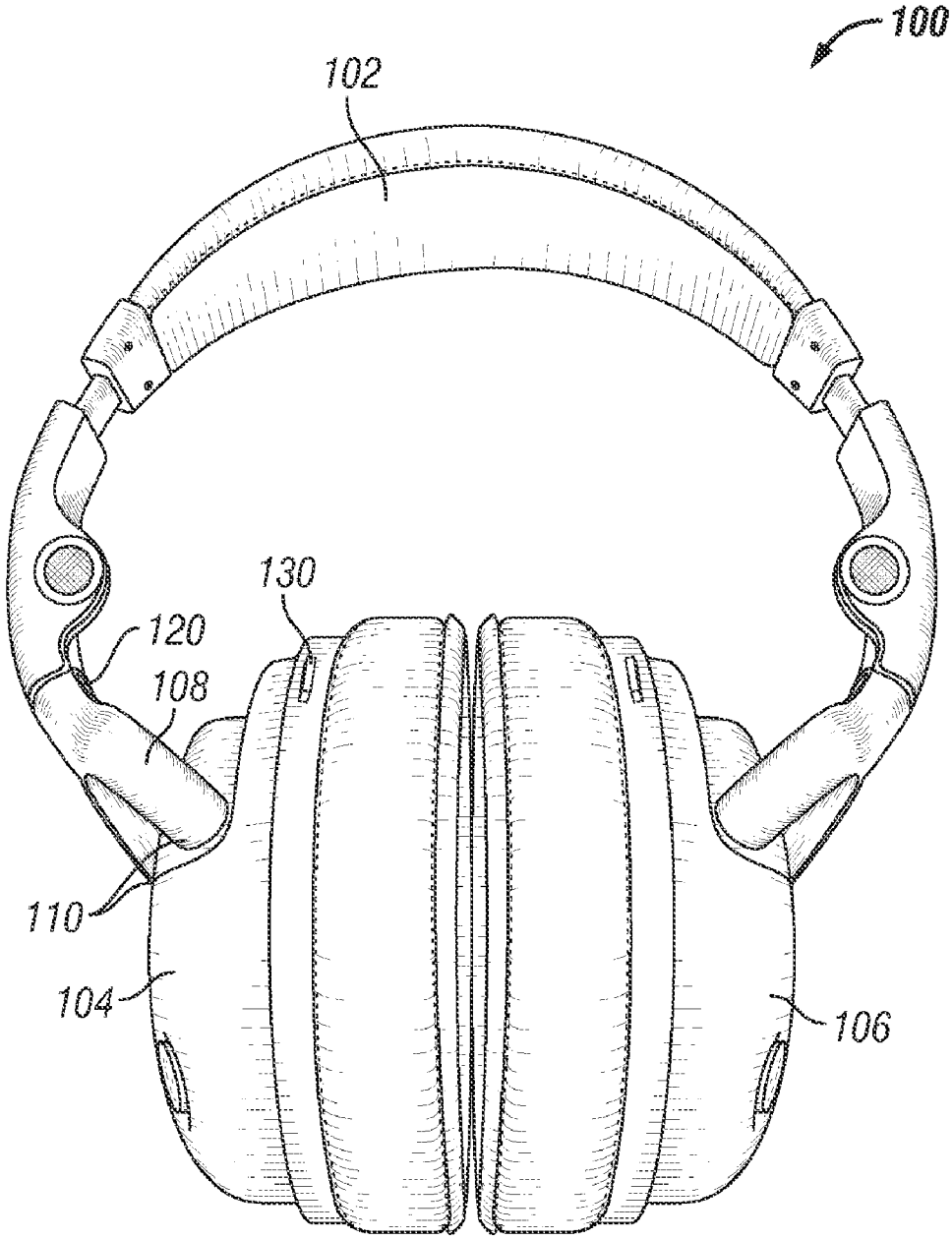
FIG. 1 shows one embodiment of an active headworn device in a contracted state off the user's head.
Figure 2:
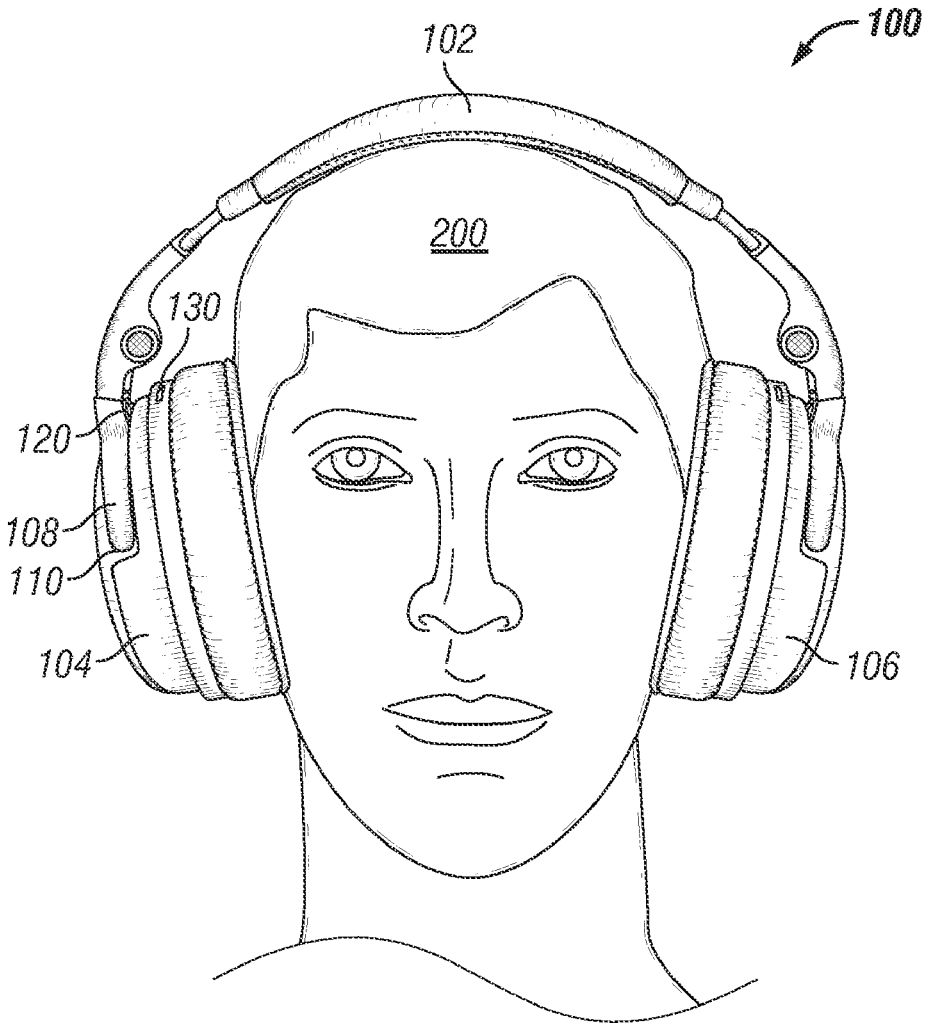
FIG. 2 shows the embodiment of FIG. 1 of the active headworn device in an extended state on a user's head.

FIGS. 1 and 2 illustrate an active headworn device 100 comprising a compliant headband 102 and earcups 104 and 106. Connected to one side of the headband 102 is a yoke 108 which pivots at pivot points 110 as the earcups 104 and 106 are moved relative to one another. Various configurations may be employed to pivotably connect the earcups with respect to the headband as would be appreciated by one of ordinary skill in the art having the benefit of this disclosure. For example, a universal ball joint may be used to pivotably connect the earcup directly to the headband. A magnet 120 is attached to the yoke 108 and a Hall-effect switch 130 is attached to the earcup 104. FIG. 1 illustrates the active headworn device 100 off the user's head in a contracted state, and FIG. 2 illustrates the active headworn device 100 on the user's head 200 in an extended state.

Referring to FIG. 1, as the earcups 104 and 106 are moved apart to place the active headworn device 100 in an extended state the distance between the magnet 120 and the Hall-effect switch 130 decreases. When the earcups 104 and 106 are moved apart sufficiently to place the active headworn device 100 on the user's head 200, the yoke 108 pivots with respect to earcup 104 such that the distance between the magnet 120 and the Hall-effect switch 130 decreases to a distance small enough that the Hall-effect switch 130 changes from the off state to the on state. In one embodiment, the stiffness of the headband 102 ensures that the earcups 104 and 106 move together as shown in FIG. 1 when the active headworn device 100 is off the user's head 200 and not held in the extended state.

Figure 3:
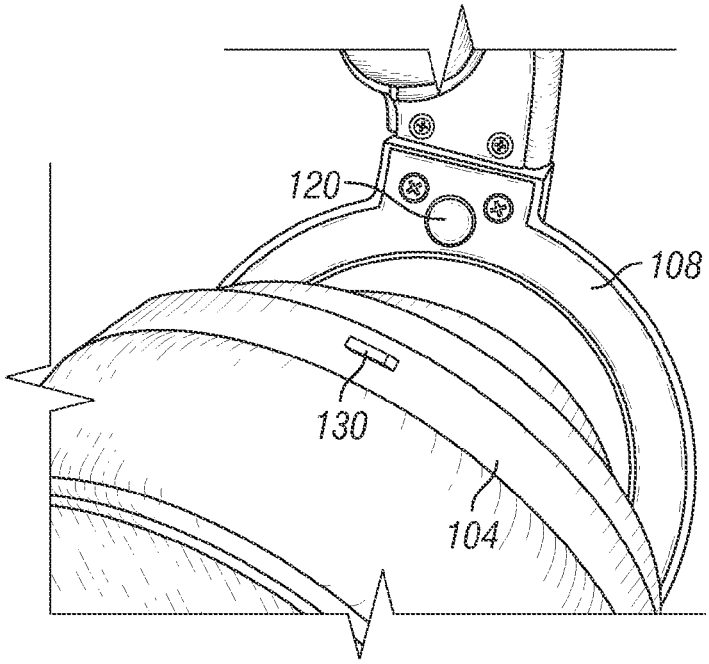
FIG. 3 shows one embodiment of a close up view of an active headworn device that uses a Hall-effect switch as a position sensor and illustrates the distance between the Hall-effect switch and a magnet when the active headworn device is off the user's head in a contracted state.
Figure 4:
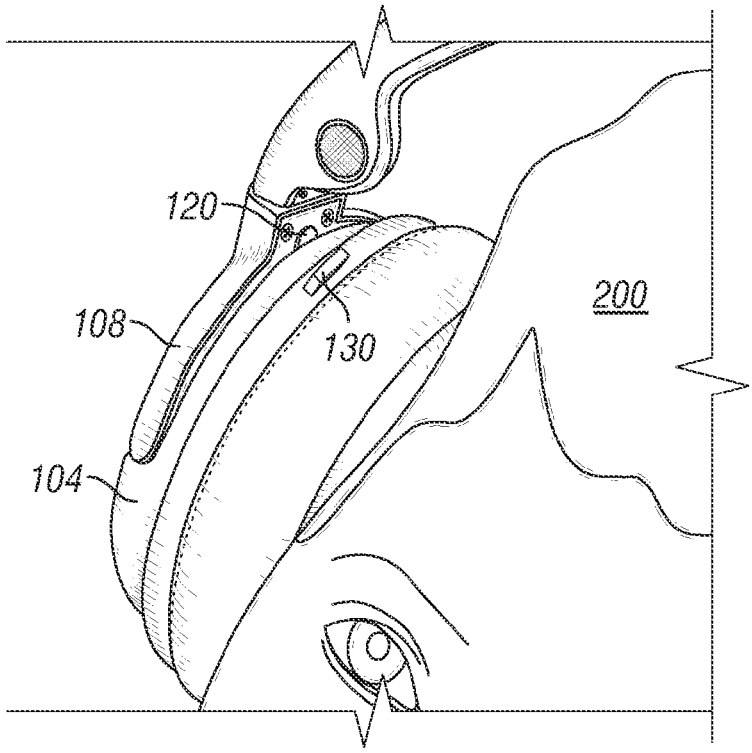
FIG. 4 shows a close up view of the embodiment of FIG. 3 illustrating the reduced distance between the Hall-effect switch and the magnet when the active headworn device is on the user's head in an extended state.

FIGS. 3 and 4 show the positions of the magnet 120 and the Hall-effect switch 130 when the active headworn device 100 is off the user's head 200 in a contracted state and when the active headworn device 100 is on the user's head in an extended state respectively. In the embodiment shown in FIGS. 1 through 4, the Hall-effect switch 130 is inside the earcup 104 and is attached to a printed circuit board which controls the operation of the active headworn device 100. The configuration of the magnet 120 and the Hall-effect switch 130 are shown for illustrative purposes only and could be varied as would be appreciated by one of ordinary skill in the art having the benefit of this disclosure.

The configuration of the magnet 120 and the Hall-effect switch 130 are preferably chosen such that the Hall-effect switch 130 is off when the active headworn device 100 is off the user's head 200 in a contracted state, as shown in FIG. 3, and that the Hall-effect switch 130 is on when the active headworn device 100 is in the extended state on the user's head 200. One example of a magnet suitable for this configuration is a commonly available disk type rare earth magnet which is primarily composed of neodymium, iron and boron and referred to as magnetic material grade N40, and which is about 0.250 inch diameter by about 0.063 inch thick. This magnet, which is commercially available through National Imports, LLC of Vienna, Va., may be used in conjunction with a Hall-effect switch. One example of a suitable Hall-effect switch is a type A3212 micropower, ultrasensitive Hall-effect switch manufactured by Allegro MicroSystems, Inc. of Worcester, Mass. Other combinations of magnet and Hall-effect switch or Hall-effect sensor may be utilized as would be appreciated by one of ordinary skill in the art having the benefit of this disclosure.

Figure 5:
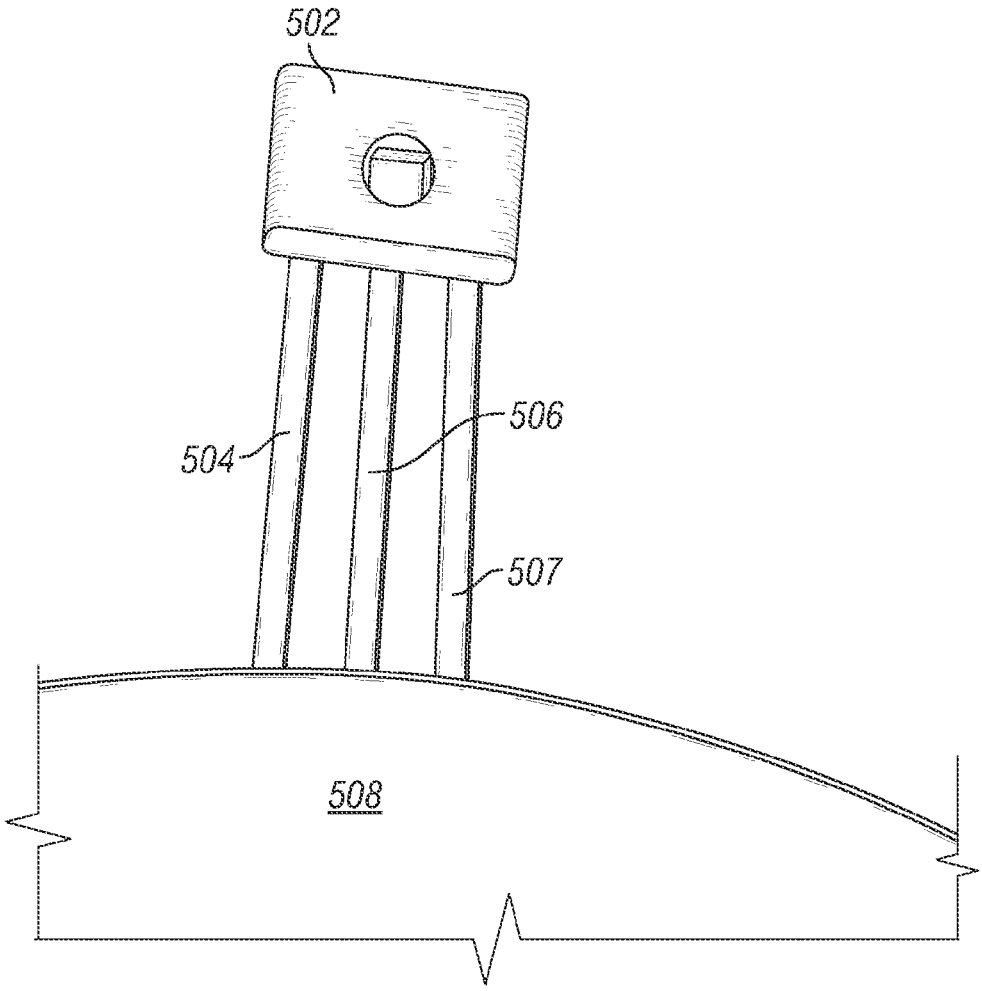
FIG. 5 illustrates one embodiment of a Hall-effect switch attached to a printed circuit board comprising circuitry which can control an active headworn device.

FIG. 5 shows a Hall-effect switch 502 attached to a printed circuit board 508 which, inter alia, controls the turning on and turning off of an active headworn device. The Hall-effect switch 502 is a three terminal device. In the case illustrated, terminal 504 is the signal line, which is connected to a microcontroller, terminal 506 is connected to circuit ground 690 (shown in FIG. 6), and terminal 507 is connected to a positive terminal 604 of a battery 602 (shown in FIG. 6). In operation, when a magnet is placed in close enough proximity to Hall-effect switch 502, the signal line is pulled low; thus if the signal line 504 is connected to a pull-up resistor 622 (shown in FIG. 6), a logic low indicates that the headworn device is in an extended state (e.g., on the user's head) and a logic high indicates that the headworn device is in a contracted state (e.g. off the user's head).

Figure 6:
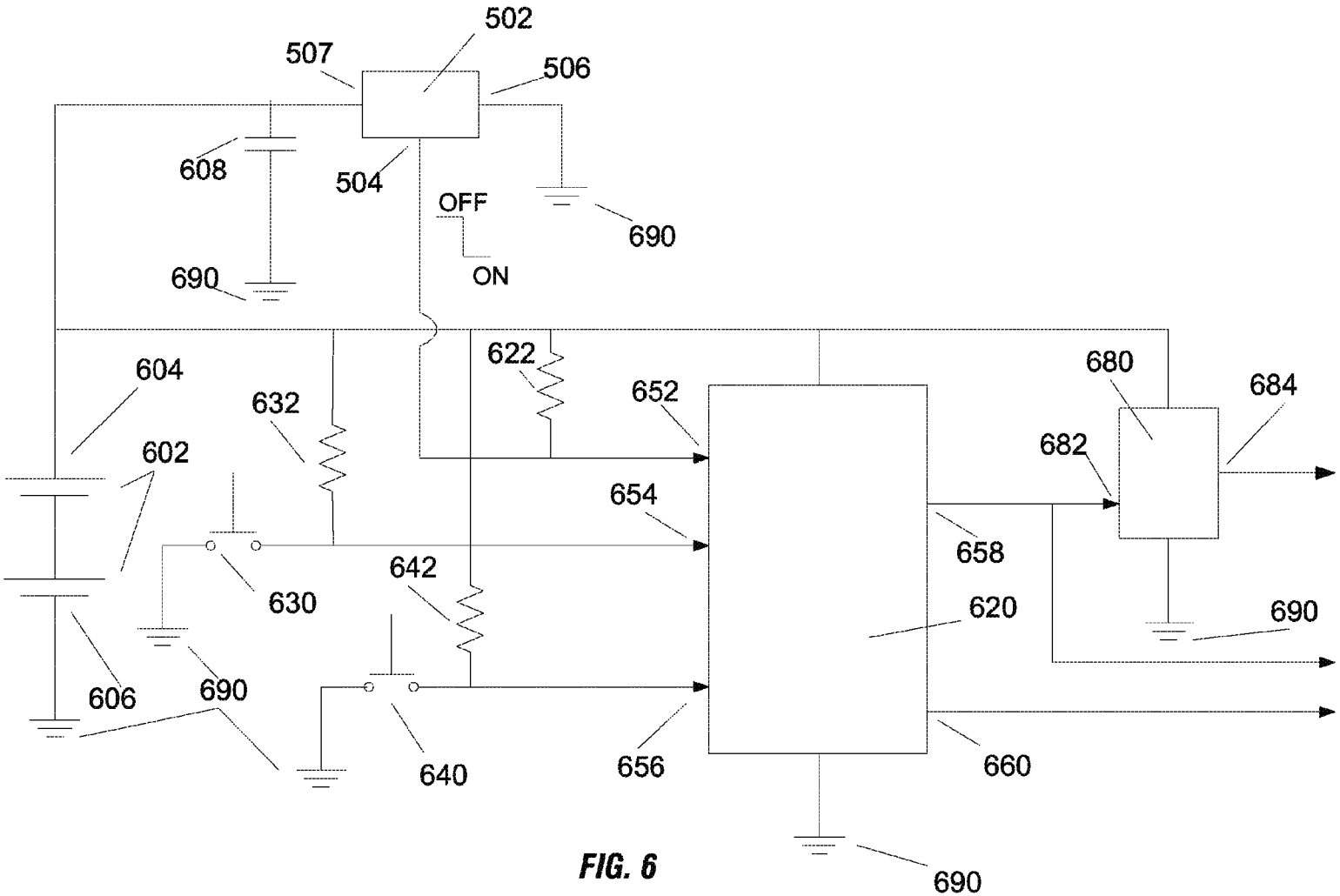
FIG. 6 is a circuit diagram according to one embodiment of an active headworn device that includes a Hall-effect switch to control the operation of the active headworn device.

FIG. 6 shows a circuit diagram according to one embodiment of an active headworn device that includes a Hall-effect switch to control the operation of the active headworn device. The signal output 504 of Hall-effect switch 502 is connected to an input terminal 652 of microcontroller 620 and to pull-up resistor 622, which may have a resistance of, for example, about 220KΩ. Terminal 507 of the Hall-effect switch 502 is connected to the positive terminal 604 of a battery 602, which may comprise, for example, two AAA batteries connected in series. Terminal 506 of the Hall-effect switch 502 is connected to circuit ground 690, which is also connected to the negative terminal 606 of the battery 602. A capacitor 608, for example a 0.1 μF capacitor, is connected between the positive terminal 604 of the battery 604 and circuit ground 690 in physical proximity to Hall-effect switch 502 to reduce noise voltage at terminal 507. The positive terminal 604 of the battery 602 is connected to and provides power to the microcontroller 620 as well as a voltage regulator 680. Further, a pull-up resistor 632 is connected between pushbutton 630 and the positive terminal 604 of the battery 602 and, similarly, pull-up resistor 642 is connected between pushbutton 640 and the positive terminal 604 of the battery 602.

The output of Hall-effect switch 502 and pushbuttons 630 and 640 are all connected to input terminals 652, 654 and 656 respectively of microcontroller 620. The microcontroller 620 runs a software program which checks the logic levels at these three input terminals (652, 654 and 656) and, based on the detailed instructions which comprise the software program, determines the logic levels at microcontroller output terminals 658 and 660 which may be adapted to control various aspects of the headworn device. One example of a suitable microcontroller is the PIC16F913, manufactured by Microchip Technologies, Inc., of Chandler, Ariz.

In operation, the logic signal at the microcontroller output 658 may, for example, enable or disable a voltage regulator 680 which may be, for example, the model TPS72215 manufactured by Texas Instruments, Dallas, Tex. When control input 682 of voltage regulator 680 is set high, a regulated voltage, for example 1.5 volts, is present at voltage regulator output pin 684; and when control input 682 is set low, circuitry connected to output pin 684 is turned off. The microcontroller output 658 along with the logic signal at microcontroller output terminal 660 may also be used to control a variety of other functions of the active headworn device 100, such as muting.

Figure 7B:
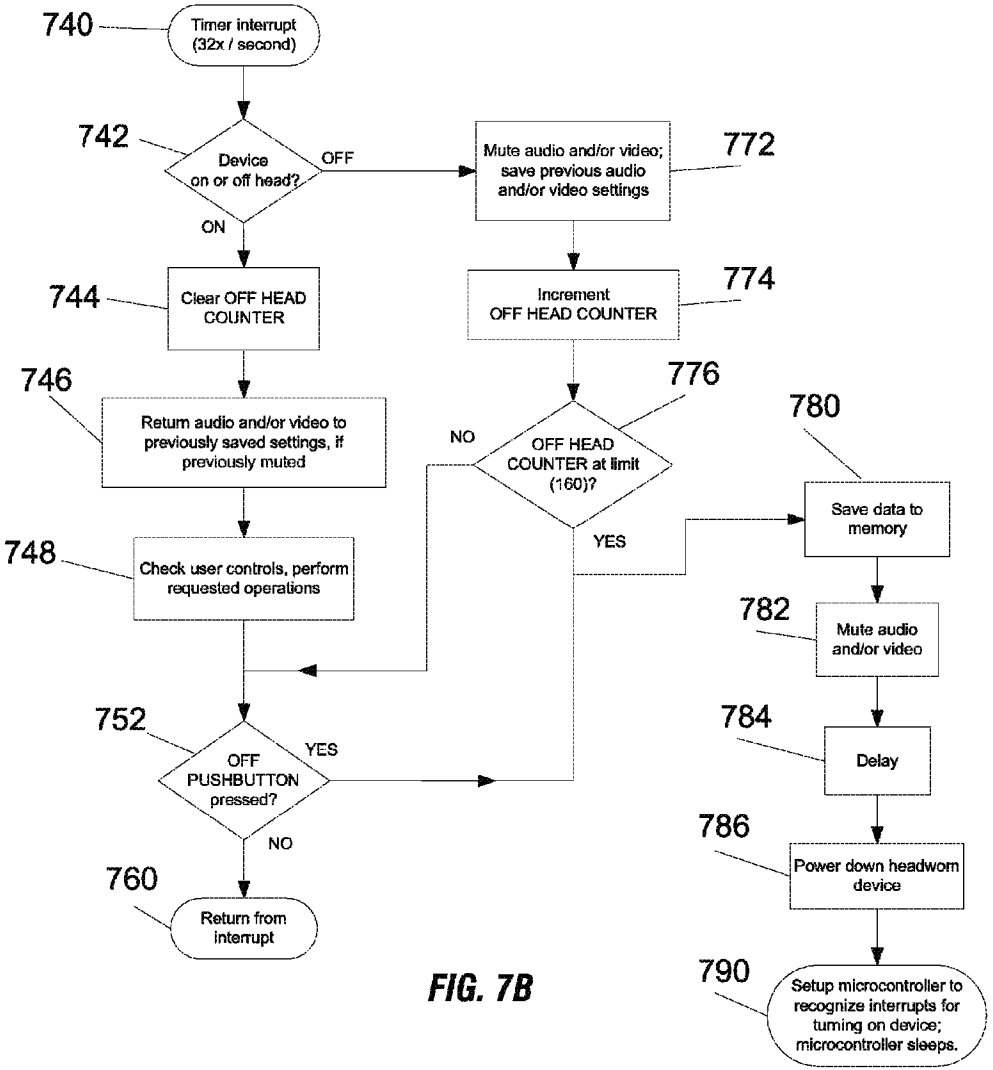
FIG. 7B is a flowchart illustrating an interrupt routine according to one embodiment.
Figure 7A:
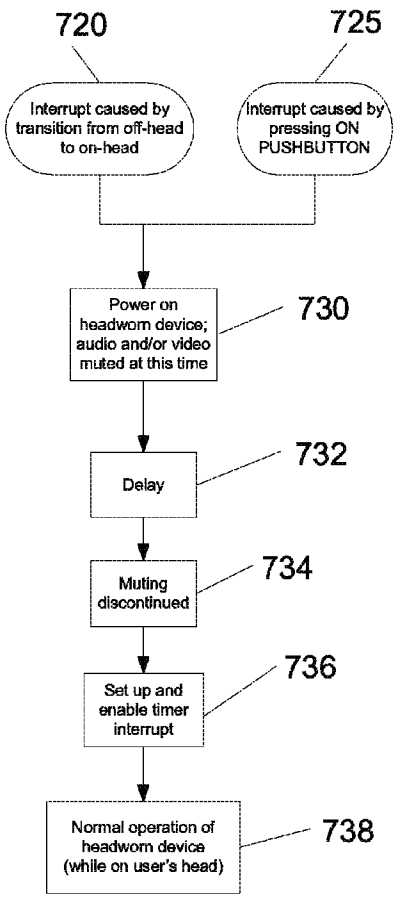
FIG. 7A is a flowchart showing startup and normal operation of the headworn device, according to one embodiment.

A flowchart of software which may run in microcontroller 620 is shown in FIGS. 7A and 7B. These flowcharts may apply to a variety of active headworn devices concerning the turning on and turning off the device as well as audio and/or video muting. The flowcharts do not illustrate the entire operation of the headworn device. The flowcharts may be applicable to various active headworn devices such as assistive listening devices, headworn devices for gaming, or headworn devices for job training or the like.

FIG. 7A is a software flowchart, showing startup and normal operation of the active headworn device. In FIG. 7A there are two distinct manners in which the headworn device may be powered on. Those are shown at steps 720 and 725. Note that when the headworn device is powered down, the microcontroller is in a low-power "sleep" state, common on many currently available microcontrollers. In the "sleep" state, very little power is utilized, yet the microcontroller can be awoken by logic level transitions at its pushbuttons as well as a logic level transition from a position sensor, for example, a Hall-effect switch which indicates whether the device is in an extended or contracted state, e.g., on or off the user's head. In this exemplary flowchart, either an interrupt caused by the user pressing the 'ON PUSHBUTTON' or an interrupt caused by the user placing the device on his or her head results in the device turning on and operating.

Following recognition of either turn-on event 720 or turn-on event 725, power is applied to the circuitry of the headworn device at step 730, however at this time the audio and/or video is muted. Subsequently, after a delay 732, at step 734 muting is discontinued. This short period of muting ensures that undesirable start-up transient events, such as undesirable sounds or visuals, are not presented to the user. Following the discontinuation of the muting, a timer interrupt, which is a very common feature of currently available microcontrollers, is enabled at step 736, and immediately thereafter, at step 738, normal operation of the active headworn device ensues. Timer interrupts may occur, for example, 32 times per second and thus, periodically, the normal operation of the headworn device is interrupted.

FIG. 7B is a software flowchart of an interrupt routine. At step 740, the microcontroller is interrupted and the microcontroller determines at step 742 whether the device is currently on the user's head in the extended state or off the user's head in the contracted state. This interrupt routine also determines whether or not the 'OFF PUSHBUTTON' is pressed at step 752. In the embodiment illustrated in FIGS. 7A and 7B, either removal of the headworn device from the user's head and remaining in the contracted state for some period of time, as described in detail below, or pressing of the 'OFF PUSHBUTTON' will result in the device powering down.

If at step 742 the device is on the user's head, normal operation continues. Conversely, if at step 742 the device is off the user's head, at step 772 audio and/or video are muted, and any previous audio and/or video settings are saved to memory. The muting at step 772 prevents the presentation of audio and/or video when the device is off the user's head, which may be desirable, for example, to eliminate undesirable audio feedback. First, the steps which occur when the device is off the user's head are described below, then the steps which occur when the device is on the user's head are described.

Following muting, a counter, referred to as the 'OFF HEAD COUNTER,' is incremented at step 774. Although not shown in the flowchart, when the headworn device is first turned on, the 'OFF HEAD COUNTER' is clear, i.e. set to zero. Also, whenever the device is on the user's head, the 'OFF HEAD COUNTER' is cleared at step 744. Then, as a result of every successive timer interrupt, provided the headworn device remains off the user's head, the 'OFF HEAD COUNTER' is again incremented at step 774. Then, when the 'OFF HEAD COUNTER' reaches a predetermined limit, as determined at step 776, the power down sequence begins at step 780. As an example, if the predetermined 'OFF HEAD COUNTER' limit equals 160, then, for an embodiment with 32 interrupts per second, the device will turn itself off after being removed from the user's head for 5 seconds. The interrupt rate and 'OFF HEAD COUNTER' limit may be varied to provide a different period in which the device will turn itself off as would be appreciated by one of ordinary skill in the art having the benefit of this disclosure. In one embodiment, the device may allow the user to increase or decrease the 'OFF HEAD COUNTER' to change the turn off period of the device.

However, if the 'OFF HEAD COUNTER' is not at its limit, as determined at step 776, the 'OFF PUSHBUTTON' is checked at step 752 to determine if it is pressed. If the 'OFF PUSHBUTTON' is pressed, execution proceeds at step 780, the beginning of the power down sequence.

In the embodiment of FIG. 7, either of two conditions result in the headworn device turning off: a) the 'OFF PUSHBUTTON' is pressed (decision point 752), or b) the device was removed from the user's head and remained off the head for a time period exceeding that represented by the 'OFF HEAD COUNTER' (decision points at steps 742 and 776).

On the other hand, if the headworn device is on the user's head at step 742 a different series of steps executes, beginning at step 744 where the 'OFF HEAD COUNTER' is cleared, as discussed above. Following this, at step 746, the audio and/or video settings are restored if the headworn device had been previously muted, as may have occurred at step 772. At this point the user controls are checked and the headworn device responds accordingly at step 748. Note that in this embodiment, the 'OFF PUSHBUTTON,' which is checked at step 752, as well as the Hall-effect switch, which was checked earlier at step 742, and the rest of the user controls are all checked during the interrupt routine, 32 times per second. For example, if the user wants to adjust an audio setting, such as tone, or a video setting, such as brightness, controls which the user utilizes for such adjustment are checked at step 748.

If at step 752 the 'OFF PUSHBUTTON' is not pressed, normal operation of the headworn device continues, which is illustrated at step 760 where the interrupt routine ends and control returns to the rest of the program. Note that step 748 is executed only if the headworn device is on the user's head; and, if the return from interrupt, step 760, executes at a time when the headworn device is off the user's head, the device remains muted. Thus, if the user removes the headworn device from his or her head for a time period less than that represented by the 'OFF HEAD COUNTER' limit, for example a few seconds, although the device will be muted for those few seconds, it will not power down; rather, when the device is returned to the user's head, muting will cease and operation of the device will continue as it was prior to its removal from the user's head.

The power down sequence is described in FIG. 7 at steps 780, 782, 784, 786 and 790, which execute sequentially. At step 780, any data which needs to be recalled the next time the unit is turned on is stored in non-volatile memory. At step 782 the audio and/or video is muted, and following a delay at step 784, power is removed from the headworn device at step 786, with the exception of the continually powered microcontroller, Hall-effect switch, and voltage regulator discussed with reference to FIG. 6. The delay at step 784 ensures that any undesirable transient audio or visual events which might occur when the device is powered down are muted.

Immediately before the headworn device powers down, at step 790, the microcontroller is set up to recognize interrupts which may be associated with turn-on of the device. In this embodiment, there are two such interrupts. One interrupt may be caused by the transition of the device from off head to on head. The other interrupt may be caused by pressing the 'ON PUSHBUTTON.' The microcontroller then enters a low power "sleep" state, waiting for the device to be turned on once again.

FIGS. 7A and 7B represent one embodiment, in which the headworn device automatically turns off and automatically turns on based on whether or not it is on the user's head. This embodiment also allows the user to turn on or turn off the device by pressing the 'ON PUSHBUTTON' or 'OFF PUSHBUTTON' respectively. Other embodiments may include only automated turn-on or automated turn-off of the active headworn device. Still other embodiments may not include either or both the 'ON PUSHBUTTON' or the 'OFF PUSHBUTTON'. Further, embodiments may recognize events other than the pressing of pushbuttons to either manually turn the device on or off. For example, an embodiment may contain volume control pushbuttons with software which recognizes when the up volume button is pressed, for manually turning on the device, or when the down volume pushbutton is pressed and held for greater than a predetermined time period, for example, for manually turning off the device.

Embodiments of the position sensing apparatus and method may be realized with or without the presence of a microcontroller. In addition, the position sensing apparatus may be, for example, a Hall-effect sensor rather than a Hall-effect switch. Further, other combinations of hardware and software may be employed in carrying out the position sensing apparatus and method in accordance with the scope of the appended claims.

Figure 8:
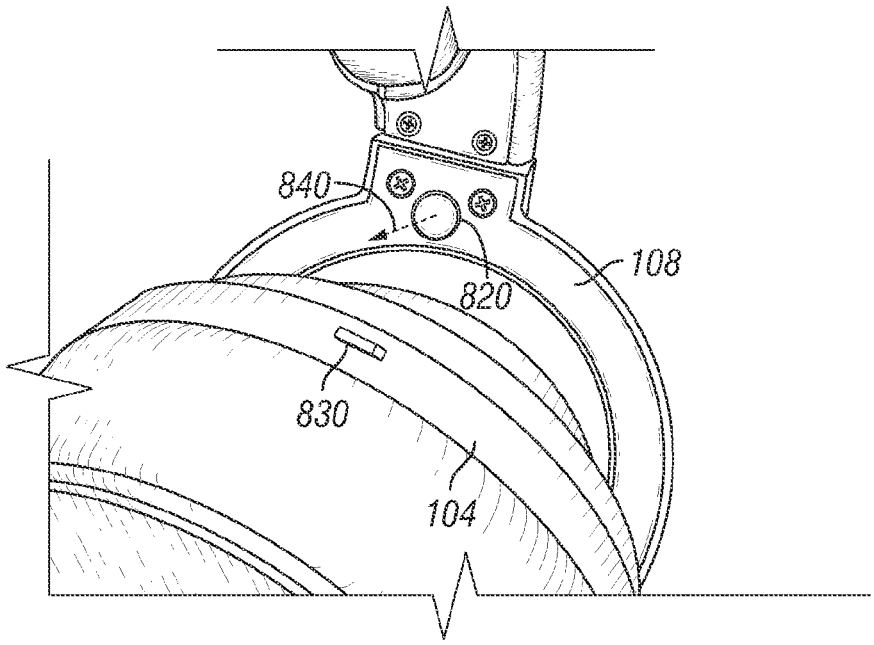
FIG. 8 shows one embodiment of a close up view of an active headworn device that uses a light detector and a light emitter as a position sensor and illustrates the distance between the light detector and the light emitter when the active headworn device is off the user's head in a contracted state.
Figure 9:
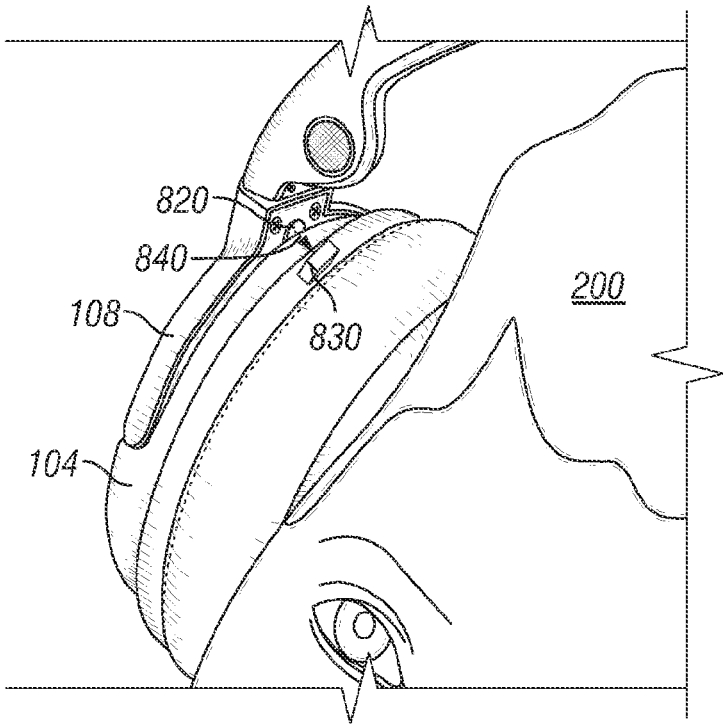
FIG. 9 shows a close up view of the embodiment of FIG. 8 illustrating the reduced distance between the light detector and the light emitter when the active headworn device is on the user's head in an extended state.

FIGS. 8 and 9 illustrate an alternative embodiment in which a light emitter, such as infrared light emitting diode type QEC122 manufactured by Fairchild Semiconductor, and a light detector, such as infrared phototransistor type QSC112 also manufactured by Fairchild Semiconductor, are mechanically coupled to an active headworn device 100 in such a manner as to detect whether or not the active headworn device 100 is in the extended position on a user's head 200. FIG. 8 shows the positions of light emitter 820 and light detector 830 when the active headworn device 100 is off the user's head 200 in a contracted state. FIG. 9 shows the positions of light emitter 820 and light detector 130 when the active headworn device 100 is on the user's head 200 in an extended state. In the embodiment shown in FIGS. 8 and 9, the infrared sensor 830 is inside the earcup 104 and is attached to a printed circuit board which controls the operation of the active headworn device 100. The configuration of the light emitter 820 and light detector 830 are shown for illustrative purposes only and could be varied as would be appreciated by one of ordinary skill in the art having the benefit of this disclosure. Other combinations of a light emitter and a light detector or sensor may be utilized as would be appreciated by one of ordinary skill in the art having the benefit of this disclosure.

The configuration of the light emitter 820 and light detector 830 are preferably chosen such that the phototransistor current is significantly greater when the active headworn device 100 is on the user's head 200 as compared to when the device is off the user's head. FIGS. 8 and 9 both illustrate the beam of light 840 emitted by light emitter 820. In the case where the active headworn device 100 is on the user's head 200 (shown in FIG. 8), the emitted light beam 840 strongly impinges upon light detector 830, thereby causing a relatively large detected signal. On the other hand, when the active headworn device 100 is off the user's head 200, the emitted light beam 840, only weakly impinges upon light detector 830. Thus, employing circuitry apparent to one skilled in the art, the output signal from light detector 830 can reliably indicate whether the active headworn device is in a contracted state as it would be if off the user's head or in an extended state as it would be if on the user's head. The power utilized in this embodiment may be minimized by checking whether the active headworn device is in its contracted or extended state periodically, thus energizing the light emitter for only a small fraction of the time, for example for a few milliseconds every 5 seconds.

Although various embodiments of the invention have been shown and described, other embodiments that are apparent to those of ordinary skill in the art, including embodiments that do not provide all of the features and advantages set forth herein, are also within the scope of this application as would be apparent to one skilled in the art. Rather, the scope of the present invention is defined only by reference to the appended claims and equivalents thereof.

What is claimed is:

1. An active headworn device comprising:

a headband movable between an extended state and a contracted state, wherein the headband is biased to the contracted state;

an earcup pivotably connected to the headband; and a position sensing device, wherein the position sensing device detects when the headband is in the extended state or in the contracted state, wherein the position sensing device includes a magnet and a Hall-effect device, wherein the distance between the magnet and the Hall-effect device decreases when the headband is moved from the contracted state to the extended state, and further wherein the magnet is coupled to a portion of the headband and the Hall-effect device is coupled to the earcup.

2. The active headworn device of claim 1 further comprising circuitry controlled by a microcontroller.

3. The active headworn device of claim 2, wherein when the headband is in the extended state the position sensing device signals the microcontroller to power up the active headworn device.

4. The active headworn device of claim 2, wherein when the headband is in the contracted state the microcontroller powers down the active headworn device.

5. The active headworn device of claim 2, wherein when microcontroller powers down the active headworn device after the headband has been in the contracted state for a predetermined time period.

6. The active headworn device of claim 1, wherein the earcup is pivotably connected to the headband via a yoke.

7. The active headworn device of claim 1, wherein the earcup is pivotably connected to the headband via a universal ball joint.

8. An active headworn device comprising:

a headband movable between an extended state and a contracted state, wherein the headband is biased to the contracted state;

an earcup pivotably connected to the headband; and a position sensing device, wherein the position sensing device detects when the headband is in the extended state or in the contracted state, wherein the position sensing device includes a magnet and a Hall-effect device, wherein the distance between the magnet and the Hall-effect device decreases when the headband is moved from the contracted state to the extended state, and further wherein the Hall-effect device is coupled to a portion of the headband and the magnet is coupled to the earcup.

9. The active headworn device of claim 8 further comprising circuitry controlled by a microcontroller.

10. The active headworn device of claim 9, wherein when the headband is in the extended state the position sensing device signals the microcontroller to power up the active headworn device.

11. The active headworn device of claim 9, wherein when the headband is in the contracted state the microcontroller powers down the active headworn device.

12. The active headworn device of claim 9, wherein when microcontroller powers down the active headworn device after the headband has been in the contracted state for a predetermined time period.

13. The active headworn device of claim 8, wherein the earcup is pivotably connected to the headband via a yoke.

14. The active headworn device of claim 8, wherein the earcup is pivotably connected to the headband via a universal ball joint.

15. An active headworn device comprising:

a headband movable between an extended state and a contracted state, wherein the headband is biased to the contracted state;

an earcup pivotably connected to the headband;

circuitry controlled by a microcontroller, wherein when the headband is in the contracted state the microcontroller mutes a portion of the circuitry; and a position sensing device, wherein the position sensing device detects when the headband is in the extended state or in the contracted state, wherein the position sensing device includes a magnet and a Hall-effect device, wherein the distance between the magnet and the Hall-effect device decreases when the headband is moved from the contracted state to the extended state, and wherein when microcontroller powers down the active headworn device after a portion of the circuitry has been muted.

16. A headworn device comprising:

a headband movable between an extended state and a contracted state, wherein in the extended state the headband is adapted to engage a user's head;

a circuit attached to the headband, the circuit providing output to the user;

a battery coupled to the circuit to power the circuit;

a position sensing device, wherein the position sensing device automatically turns off the circuit when the headband is in the compressed state and automatically turns on the circuit when the headband is in the extended state, wherein the position sensing device includes a Hall-effect device and a magnet; and a microcontroller coupled to the position sensing device, wherein the microcontroller is adapted to mute the output to the user for a predetermined time period prior to the position sensing device turning off or on the circuit.

17. The headworn device of claim 16, wherein the headband is biased to the contracted state.

18. A method for automatically turning off an active device that includes a battery powered circuit, the method comprising:

providing an output from a portion of the circuit to a user wearing the device;

removing the active device from the user, wherein the active device moves from an extended state to a contracted state;

signaling a microcontroller with a position sensing device, wherein the signal indicates that the active device has moved to the contracted state;

muting the output portion of the circuit upon receiving the signal from the position sensing device prior to powering down the circuit; and powering down the circuit of the active device upon receipt of the signal at the microcontroller.

19. The method of claim 18 further comprising saving output data to memory.

* * * * *